US011098428B2

(12) United States Patent
Adams et al.

(10) Patent No.: US 11,098,428 B2
(45) Date of Patent: Aug. 24, 2021

(54) WASHER AND WASHER CONTROL WITH CYCLES FOR LAUNDRY ADDITIVES AND COLOR SAFE BLEACHES/IN-WASH STAIN REMOVERS

(71) Applicant: WHIRLPOOL CORPORATION, Benton Harbor, MI (US)

(72) Inventors: Joseph W. Adams, Baroda, MI (US); Colleen M. Doyle, Ann Arbor, MI (US); Michael S. Hendrickson, Stevensville, MI (US); Joel A. Luckman, Stevensville, MI (US); Tremitchel Wright, Elkhart, IN (US); Timothy N. Aykroyd, Carmel, IN (US); Robert D. Riehle, Boston, MA (US)

(73) Assignee: Whirlpool Corporation, Benton Harbor, MI (US)

( * ) Notice: Subject to any disclaimer, the term of this patent is extended or adjusted under 35 U.S.C. 154(b) by 429 days.

(21) Appl. No.: 16/114,626

(22) Filed: Aug. 28, 2018

(65) Prior Publication Data

US 2019/0024286 A1 Jan. 24, 2019

Related U.S. Application Data

(60) Division of application No. 14/794,902, filed on Jul. 9, 2015, now Pat. No. 10,094,061, which is a (Continued)

(51) Int. Cl.
*D06F 33/00* (2020.01)
*D06F 35/00* (2006.01)
(Continued)

(52) U.S. Cl.
CPC ..... *D06F 33/00* (2013.01); *D06F 34/28* (2020.02); *D06F 35/008* (2013.01); *D06F 39/02* (2013.01); *D06F 2214/00* (2013.01)

(58) Field of Classification Search
CPC ..... D06F 33/02; D06F 34/28; D06F 35/008; D06F 39/02; D06F 2214/00; D06F 39/005; D06F 35/006; D06F 39/003
(Continued)

(56) References Cited

U.S. PATENT DOCUMENTS 2,430,668 A * 11/1947 Chamberlin ..... D06F 33/00 68/12.02
3,982,666 A * 9/1976 Kleimola ..... D06F 39/022 222/651
(Continued)

FOREIGN PATENT DOCUMENTS

EP 1452636 1/2004
EP 1452636 A2 * 9/2004 ..... D06F 33/00
(Continued)

*Primary Examiner* — David G Cormier
*Assistant Examiner* — Thomas Bucci
(74) *Attorney, Agent, or Firm* — Price Heneveld LLP

(57) ABSTRACT

A washer and a control for an automatic washer to operate the washer through a wash cycle selected based upon a range of conditions of a fabric load to be washed. The control has a plurality of selectable stain type entrees, each with a particular dedicated wash cycle. The control also has dispensing control over at least two wash liquor additives, one being a detergent and the other being an oxidizing agent. The control operates the dedicated wash cycles, as selected, using both the detergent and the oxidizing agent; however, the detergent and the oxidizing agent may be dispensed differently, depending on the stain type selected.

20 Claims, 11 Drawing Sheets

Related U.S. Application Data continuation of application No. 11/745,004, filed on May 7, 2007, now Pat. No. 9,091,010.

(51) Int. Cl.
*D06F 39/02* (2006.01)
*D06F 34/28* (2020.01)

(58) Field of Classification Search
USPC .... 68/12.01, 17 R, 207, 12.27, 12.18, 12.12, 68/12.02, 12.23, 12.19; 8/158, 159, 137, 8/111
See application file for complete search history.

(56) References Cited

U.S. PATENT DOCUMENTS 3,988,908 A * 11/1976 Beare ..... D06F 39/026 68/12.18
4,110,075 A * 8/1978 Graf ..... C11D 11/0064 68/17 R
4,120,650 A * 10/1978 Kappler ..... D06L 4/23 8/109
4,503,575 A * 3/1985 Knoop ..... D06F 39/045 8/158
5,014,211 A * 5/1991 Turner ..... B01F 15/0416 137/266
5,297,307 A * 3/1994 Baek ..... D06F 33/00 8/159
5,325,677 A * 7/1994 Payne ..... D06F 37/203 68/12.01
5,870,906 A * 2/1999 Denisar ..... D06F 39/022 68/17 R
5,897,671 A * 4/1999 Newman ..... D06F 39/022 8/158
6,055,831 A * 5/2000 Barbe ..... D06F 39/022 137/557
6,502,265 B2 * 1/2003 Blair ..... D06F 34/28 8/159
6,671,916 B2 * 1/2004 Herr ..... D06F 34/28 8/159
6,792,637 B2 * 9/2004 Reichold ..... A47L 15/0055 68/12.02
7,246,395 B2 * 7/2007 Buckroyd ..... D06F 34/28 8/158
7,310,893 B2 * 12/2007 Woerdehoff ..... D06F 34/28 34/527
7,337,634 B2 * 3/2008 Buckroyd ..... D06F 34/28 68/12.23
7,404,225 B2 * 7/2008 Jo ..... D06F 34/28 8/158
9,003,317 B2 * 4/2015 Beaudet ..... D06F 93/00 715/764
9,091,010 B2 * 7/2015 Luckman ..... D06F 35/008
2001/0049846 A1 * 12/2001 Guzzi ..... D06F 33/00 8/158
2001/0049947 A1 * 12/2001 Whah ..... D06F 39/06 68/12.02
2002/0078511 A1 * 6/2002 Blair ..... D06F 34/28 8/159
2003/0051296 A1 * 3/2003 Broker ..... D06F 35/006 8/158
2003/0154560 A1 * 8/2003 Behrens ..... D06F 34/28 8/159
2004/0060123 A1 * 4/2004 Lueckenbach ..... D06F 34/14 8/159
2004/0107510 A1 * 6/2004 Buckroyd ..... D06F 34/28 8/159
2004/0134238 A1 * 7/2004 Buckroyd ..... D06F 34/28 68/12.23
2005/0022314 A1 * 2/2005 Ambuter ..... A47L 15/0055 8/158
2006/0081016 A1 * 4/2006 Hsu ..... D06F 39/022 68/12.18
2006/0107705 A1 * 5/2006 Hsu ..... D06F 39/022 68/17 R
2008/0276382 A1 * 11/2008 Benne ..... D06F 58/30 8/158
2008/0276965 A1 * 11/2008 Aykroyd ..... D06F 33/00 134/18
2010/0000023 A1 * 1/2010 McAllister ..... D06F 33/00 8/137
2010/0000024 A1 * 1/2010 Hendrickson ..... D06F 34/28 8/137
2010/0000025 A1 * 1/2010 Dalton ..... A47L 15/44 8/137
2010/0000265 A1 * 1/2010 Hendrickson ..... D06F 33/00 68/12.18
2012/0056827 A1 * 3/2012 Kim ..... D06F 34/32 345/173
2013/0239337 A1 * 9/2013 Kim ..... D06F 34/18 8/137
2013/0290902 A1 * 10/2013 Martin ..... D06F 34/28 715/823
2015/0345068 A1 * 12/2015 Coffman ..... G06F 3/0482 715/771
2016/0312396 A1 * 10/2016 Cruickshank ..... D06F 34/28
2019/0153653 A1 * 5/2019 Clayton ..... D06F 39/008

FOREIGN PATENT DOCUMENTS

JP 63318997 12/1988
JP 63318997 A * 12/1988

* cited by examiner

ADD WATER
40
SOAK SELECTED?
42
YES
NO
WATER LEVEL?
44
REGULAR
LOW
GARMENTS PRESENT?
46
NO
YES
ADD 1-2X THE RECOMMENDED AMOUNT OF PEROXIGEN AGENTS AT START OF CYCLE
52
ADD RECOMMENDED AMOUNT OF PEROXIGEN AGENTS
56
POTENTIAL PHASES?
58

ADD WATER
140
SOAK SELECTED?
142
NO
WATER LEVEL?
170
HIGH
LOW
REGULAR

UTILIZE RECICULATION
172
YES
NO
ENTIRE DETERGENT DISPENSED BETWEEN 0-10 MIN.
174
FOAM
186
STEAM
188
POTENTIAL PHASES?
184
CONCENTRATED LIQUOR
190

ADD WATER
140
SOAK SELECTED?
142
YES
NO
WATER LEVEL?
170
HIGH
REGULAR
AGITATION TIME
202
EXTENDED
SHORT
1ST ADDITIVE
204
DETERGENT
PEROXIGEN AGENTS
ADD DETERGENT BETWEEN +0-10 MIN.
206
ADD PEROXIGEN AGENTS BETWEEN +0-10 MIN.
210
WATER TEMP.
214
ANY TEMP
COLD SPECIFICALLY (<25° C)
1ST ADDITIVE
216
PEROXIGEN AGENTS
DETERGENT
ADD PEROXIGEN AGENTS BETWEEN +0-10 MIN.
218

| FIG. 5A | FIG. 5B |
| --- | --- |
| FIG. 5C | |

WASHER AND WASHER CONTROL WITH CYCLES FOR LAUNDRY ADDITIVES AND COLOR SAFE BLEACHES/IN-WASH STAIN REMOVERS

CROSS-REFERENCE

The present application is a divisional of U.S. patent application Ser. No. 14/794,902 filed Jul. 9, 2015, titled WASHER AND WASHER CONTROL WITH CYCLES FOR LAUNDRY ADDITIVES AND COLOR SAFE BLEACHES/IN-WASH STAIN REMOVERS, which is a continuation of U.S. patent application Ser. No. 11/745,004 filed May 7, 2007, titled WASHER AND WASHER CONTROL WITH CYCLES FOR LAUNDRY ADDITIVES AND COLOR SAFE BLEACHES/IN-WASH STAIN REMOVERS, now U.S. Pat. No. 9,091,010, the entire disclosures of which are hereby incorporated herein by reference.

BACKGROUND OF THE INVENTION

The present invention relates to clothes washers and washer controls.

In the washing of fabrics, it is known to use bleaching agents to remove different types of stains. The bleaching agents may be combined with the detergent chemistries, such as being already combined in the detergent liquid or powder sold to the appliance user. In such situations, the bleaching agent is incorporated into the wash liquor at the same time as other cleaning chemistries, such as enzymes, and the two types of chemistries may counteract or lessen the effectiveness of the other, thereby reducing the potential cleaning ability of the detergent.

Where the bleaching agents and the detergent are introduced separately, only rudimentary washer controls have been provided to automatically dispense the bleaching agent additive at a certain predetermined point in the wash cycle, regardless of the type of stain or soil present in the wash load. Even though different stains and soils are removed more effectively with different types of detergents or bleaching agents, or combinations of the two provided at varying times during the wash cycle, controls for washers have not been provided to take advantage of the more effective combinations or times of delivery.

SUMMARY OF THE INVENTION

In an embodiment of the invention, a control is provided for an automatic washer to operate the washer through a wash cycle selected based upon a range of conditions of a fabric load to be washed. In an embodiment of the invention, the control has a plurality of selectable stain type entrees, each with a particular dedicated wash cycle. The control also has dispensing control over at least two wash liquor additives, one being a detergent and the other being a bleach in the form of an oxidizing agent. The control operates the dedicated wash cycles, as selected, using both the detergent and the oxidizing agent, however, the detergent and the oxidizing agent may be dispensed in different orders and at different times and in different amounts, depending on the stain type selected.

The stain types which may be provided by the control could include at least two of grass, blood, cocoa, carbon, red wine, tea, coffee, perspiration, dirt, mud and oily soils.

In an embodiment, the control could also include selectable water level entrees. The water level entrees could comprise high, low and regular water levels.

In an embodiment, the control could also include a selection for recirculation of the wash liquor.

In an embodiment, the control could also include selectable agitation time entrees. For example, the agitation time entrees could comprise short, extended and regular agitation times.

In an embodiment, the control could also include selectable water temperature entrees. For example, the water temperature entrees could comprise hot, warm, cold and any temperature.

In an embodiment, the control could be arranged to dispense the oxidizing agent either instantaneously in bulk or at a controlled rate.

In an embodiment, the control could include a user input for selecting at least one of the stain type entrees.

In an embodiment, the control could include an electronic input for receiving a signal indicative of at least one of the stain type entrees.

In an embodiment of the invention, an automatic washer is provided for cleaning a load of fabric. The washer includes a wash zone for receiving the load of fabric, a first chamber for receiving a detergent additive, a second chamber for receiving an oxidizing agent additive, and a control arranged to operate the washer through a wash cycle selected based upon a range of conditions of the fabric load to be washed. The control has a plurality of selectable stain type entrees, each with a particular dedicated wash cycle. The control has dispensing control over the first chamber and the second chamber for selectively dispensing the detergent and the oxidizing agent during the wash cycle. The control operates the dedicated wash cycles, as selected, using both the detergent and the oxidizing agent, however, dispensing the detergent and the oxidizing agent in different orders and at different times, depending on the stain type selected.

In an embodiment of the invention, a control for an automatic washer is provided to operate the washer through a wash cycle selected based upon a range of conditions of the fabric load to be washed and upon a range of operating parameters selected. The control has a plurality of selectable stain type entrees, each with a particular dedicated wash cycle. The control has dispensing control over at least two wash liquor additives, comprising a detergent and an oxidizing agent. The control has dispensing control over hot water and cold water inlet valves and has a timer. The control operates the dedicated wash cycles, as selected, using both the detergent and the oxidizing agent, however, dispensing the detergent and the oxidizing agent in different orders and at different times, depending on the stain type selected.

In an embodiment, the control could also include selectable water level entrees.

In an embodiment, the control could also include selectable agitation time entrees.

In an embodiment, the control could also include selectable water temperature entrees.

In an embodiment, a washer is provided for cleaning a load of fabric, and includes a wash zone for receiving the load of fabric; a first chamber for receiving a detergent additive; a second chamber for receiving an oxidizing agent additive; and a control arranged to operate the washer through a dedicated wash cycle. The control has a control interface to permit the selection by a user of one of a plurality of stain type entrées stored in a memory of the control, wherein each of the stain type entrées is associated with a particular dedicated wash cycle stored in the memory of the control. The control is configured to automatically select the dedicated wash cycle associated with the selected one of the plurality of stain type entrées. The control is operatively connected to the first chamber and the second chamber to provide dispensing control for selectively dispensing the detergent and the oxidizing agent during the dedicated wash cycle. The control is configured to operate the dedicated wash cycle, as automatically selected, using both the detergent and the oxidizing agent. The control is configured to dispense the detergent and the oxidizing agent differently based on the selected stain type.

In an embodiment, a method is provided for cleaning a load of fabric. Included in the method are defining a wash zone for receiving the load of fabric; providing a first chamber for receiving a detergent additive; providing a second chamber for receiving an oxidizing agent additive; providing a control arranged to operate the washer through a dedicated wash cycle; providing a control interface to permit the selection by a user of one of a plurality of stain type entrées stored in a memory of the control, wherein each of the stain type entrées is associated with a particular dedicated wash cycle stored in the memory of the control; automatically selecting the dedicated wash cycle associated with the selected one of the plurality of stain type entrées; operatively connecting the control to the first chamber and the second chamber to provide dispensing control for selectively dispensing the detergent and the oxidizing agent during the dedicated wash cycle; operating the dedicated wash cycle, as automatically selected, using both the detergent and the oxidizing agent; and dispensing the detergent and the oxidizing agent differently based on the selected stain type.

DETAILED DESCRIPTION OF THE PREFERRED EMBODIMENTS

Figure 1:
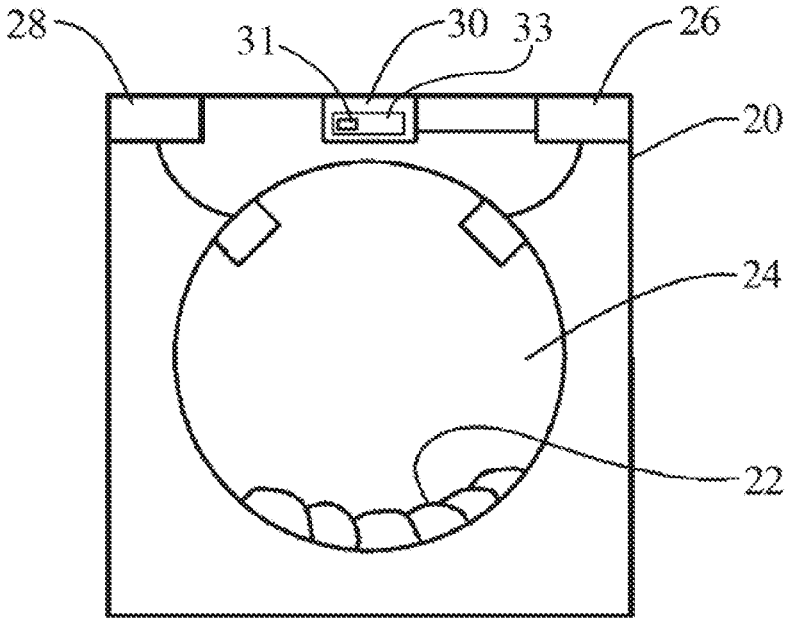
FIG. 1 is a schematic illustration of a wash machine with a wash zone.

In an embodiment of the invention, an automatic washer 20 is provided for cleaning a load of fabric 22. The washer includes a wash zone 24 for receiving the load of fabric 22, a first chamber 26 for receiving a detergent additive, a second chamber 28 for receiving an oxidizing agent additive, and a control 30 arranged to operate the washer 20 through a wash cycle selected based upon a range of conditions of the fabric load 22 to be washed. The control 30 has a plurality of selectable stain type entrees, each with a particular dedicated wash cycle. The control 30 has dispensing control over the first chamber 26 and the second chamber 28 for selectively dispensing the detergent and the oxidizing agent during the wash cycle. The control 30 operates the dedicated wash cycles, as selected, using both the detergent and the oxidizing agent, however, dispensing the detergent and the oxidizing agent in different orders and at different times, depending on the stain type selected.

The washer 20 could also include other chambers controlled by the control 30 for dispensing other additives or chemistries, such as fabric softeners and non-oxidizing bleaches. Each of the additives or chemistries, including the detergent and oxidizing agent, could be provided in liquid or powder form. A mixing chamber could also be provided wherein one or more of the additives or chemistries could be introduced to a portion of the wash liquor, and diluted therein, before being introduced to the fabric load.

In an embodiment of the invention, the control 30 is provided for the automatic washer 20 to operate the washer through a series of steps in a wash cycle selected based upon a range of conditions of the fabric load 22 to be washed and perhaps also based upon other conditions or parameters that may be selected or detected. The control 30 has a plurality of selectable stain type entrees, each with a particular dedicated wash cycle. For example, the stain types which may be listed by the control could include grass, blood, cocoa, carbon, red wine, tea, coffee and oily soils.

The stain types could be identified adjacent to rotatable selector switches, on or near push buttons, on individual key pad entries, or could be electronically displayed in a control menu 31. Other known types of display and selection modes could also be used. The stain types might also be maintained in a memory of the control, whether that memory is part of software, firmware or is hard wired. The stain types could be selected by a user through a control interface 33. Also, the control could include an electronic input for receiving a signal indicative of at least one of the stain type entrees. In this way, the stain types could be selected based upon a detection of the stains present prior to or during the wash cycle, such as by a reflectivity or emissivity reading of the fabric load, or a sensing of the presence of particular stain attributes during the wash cycle, such as the presence of proteins being released into the wash liquor.

The control 30 has dispensing control over at least two wash liquor additives, one being a detergent and the other being an oxidizing agent.

The detergent may include additives or detergent chemistries including surfactants, emulsifiers, enzyme activated stain removers, sudsing agents, builders, anti-redeposition polymers and perfumes, and may be an aqueous or non-aqueous solution or mixture.

The oxidizing agents to be added to the wash zone are active oxygen releasing compounds, e.g., peroxides (peroxygen compounds) such as perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, and the like. These agents also include peroxy acids and organic peroxides and various mixtures thereof.

A peroxy acid is an acid in which an acidic —OH group has been replaced by an —OOH group. They are formed chiefly by elements in groups 14, 15 and 16 of the periodic table, but boron and certain transition elements are also known to form peroxy acids. Sulfur and phosphorus form the largest range of peroxy acids, including some condensed forms such as peroxydiphosphoric acid, H.sub.4P.sub.2O.sub.8 and peroxydisulfuric acid, H.sub.2S.sub.2O.sub.8. This term also includes compounds such as peroxy-carboxylic acids and meta-chloroperoxybenzoic acid (mCPBA).

Organic peroxides are organic compounds containing the peroxide functional group (ROOR'). If the R' is hydrogen, the compound is called an organic hydroperoxide. Peresters have general structure RC(O)OOR. The O—O bond easily breaks and forms free radicals of the form RO*. This makes organic peroxides useful for cleaning purposes.

There are four possible descriptions of the oxidizing agent product composition based on concentration. "Ultra concentrated" means that 80 to 100% of the bleach is active. "Concentrated" means that 40 to 79% of the bleach is active. "Bleach with additive" means that 20-40% of the bleach is active. "Cleaning product with bleach" means that less than 25% of the bleach is active.

Oxidizing agents may be combined within a mixture that has a selection of other material, such as one or more of the following: builders, surfactants, enzymes, bleach activators, bleach catalysts, bleach boosters, alkalinity sources, anti-bacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, water soluble polymers, water swellable polymers and mixtures thereof.

A particular oxidizing agent to be added to form the oxidizing agent wash liquor could comprise a combination of water with one or more of sodium carbonate, sodium percarbonate, surfactants and enzymes.

The control 30 operates the dedicated wash cycles, as selected, using both the detergent and the oxidizing agent, however, the detergent and the oxidizing agent may be dispensed in different orders and at different times and in different amounts, as detailed below, depending on the stain type selected.

The control 30 may also have dispensing control over other types of chemistries including pre-wash chemistries, fabric softeners, water softeners, fragrances, anti-static agents, drying aids, de-wrinkling chemistries, deodorizers, etc.

In an embodiment, the control 30 could also include selectable water level entrees or wash liquor entrees. In this embodiment, the control 30 would have dispensing control over hot water and cold water inlet valves or other inlet valves for dispensing a wash liquor into the wash zone 24. The water level or wash liquor entrees could comprise high, low and regular levels. A sensor in the wash tub, or in the inlet lines could be used to determine the volume of water or wash liquor that had been introduced into the wash zone 24. These selections could be made by the user through the control interface, or could be selected automatically by the control 30 based on other selected parameters or based on sensed parameters of the fabric load 26.

In an embodiment, the control 30 could also include a selection for recirculation of the wash liquor. This selection could be made by the user through the control interface, or could be selected automatically by the control 30 based on other selected parameters or based on sensed parameters of the fabric load 26.

In an embodiment, the control 30 could also include selectable agitation time entrees. The control 30 could include a timer for controlling the agitation times. For example, the agitation time entrees could comprise short, extended and regular agitation times. These selections could be made by the user through the control interface, or could be selected automatically by the control 30 based on other selected parameters or based on sensed parameters of the fabric load 26.

In an embodiment, the control 30 could also include selectable water temperature entrees. For example, the water temperature entrees could comprise hot, warm, cold, tap cold and any temperature. These selections could be made by the user through the control interface, or could be selected automatically by the control 30 based on other selected parameters or based on sensed parameters of the fabric load 26.

In an embodiment, the control 30 could be arranged to dispense the oxidizing agent either instantaneously in bulk or at a controlled rate. This control feature could be selected by the user through the control interface, or could be selected automatically by the control based on other selected parameters or based on sensed parameters of the fabric load 26.

Specific wash cycles are illustrated in FIGS. 2-5.

Figures 2, 2A, 2B, 3:
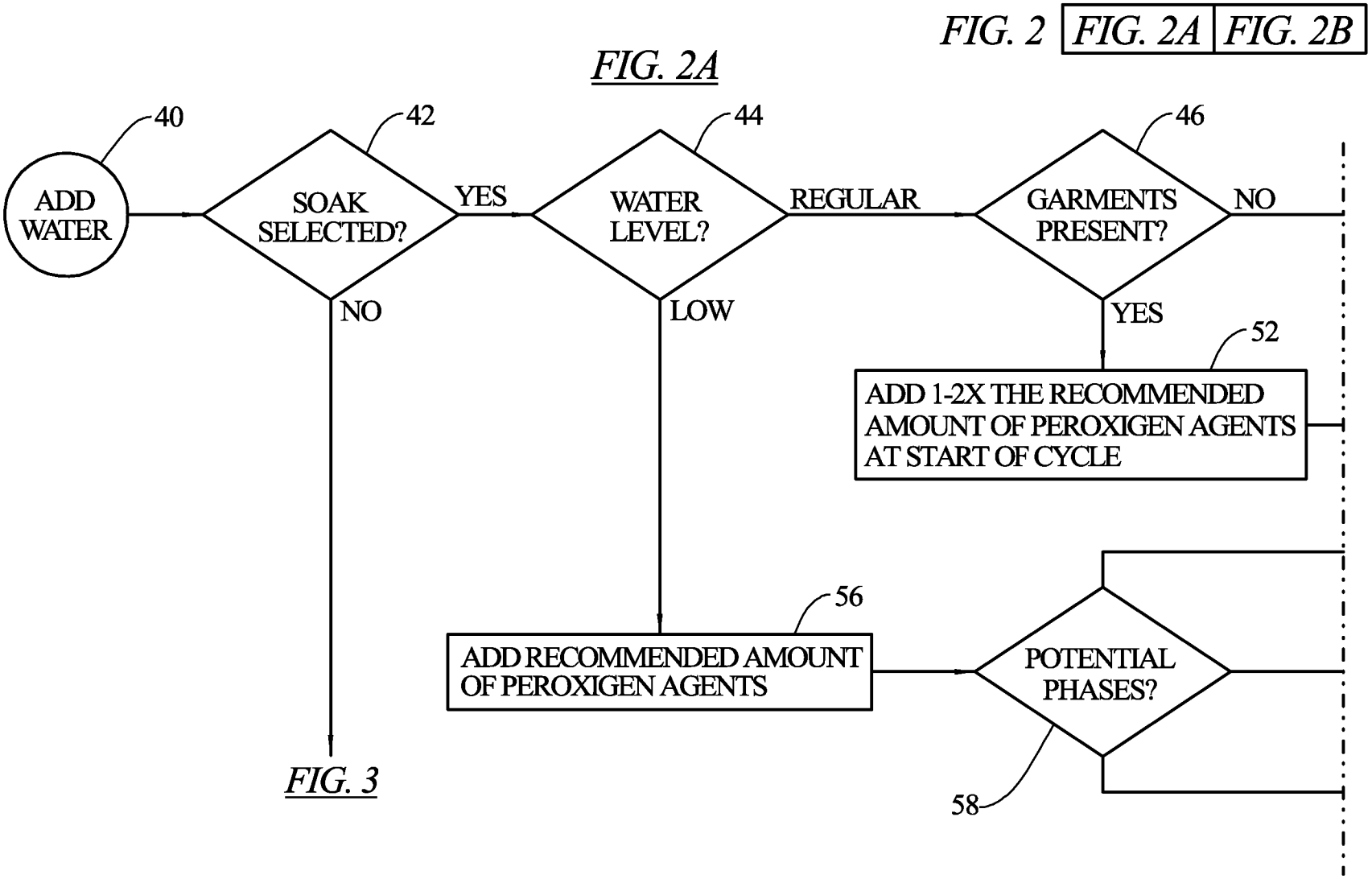
FIGS. 2 and 2A-2B illustrate a flow chart diagram of a wash cycle embodying the principles of the present invention.
FIGS. 3 and 3A-3B illustrate a flow chart diagram of a wash cycle embodying the principles of the present invention.
Figure 2B:
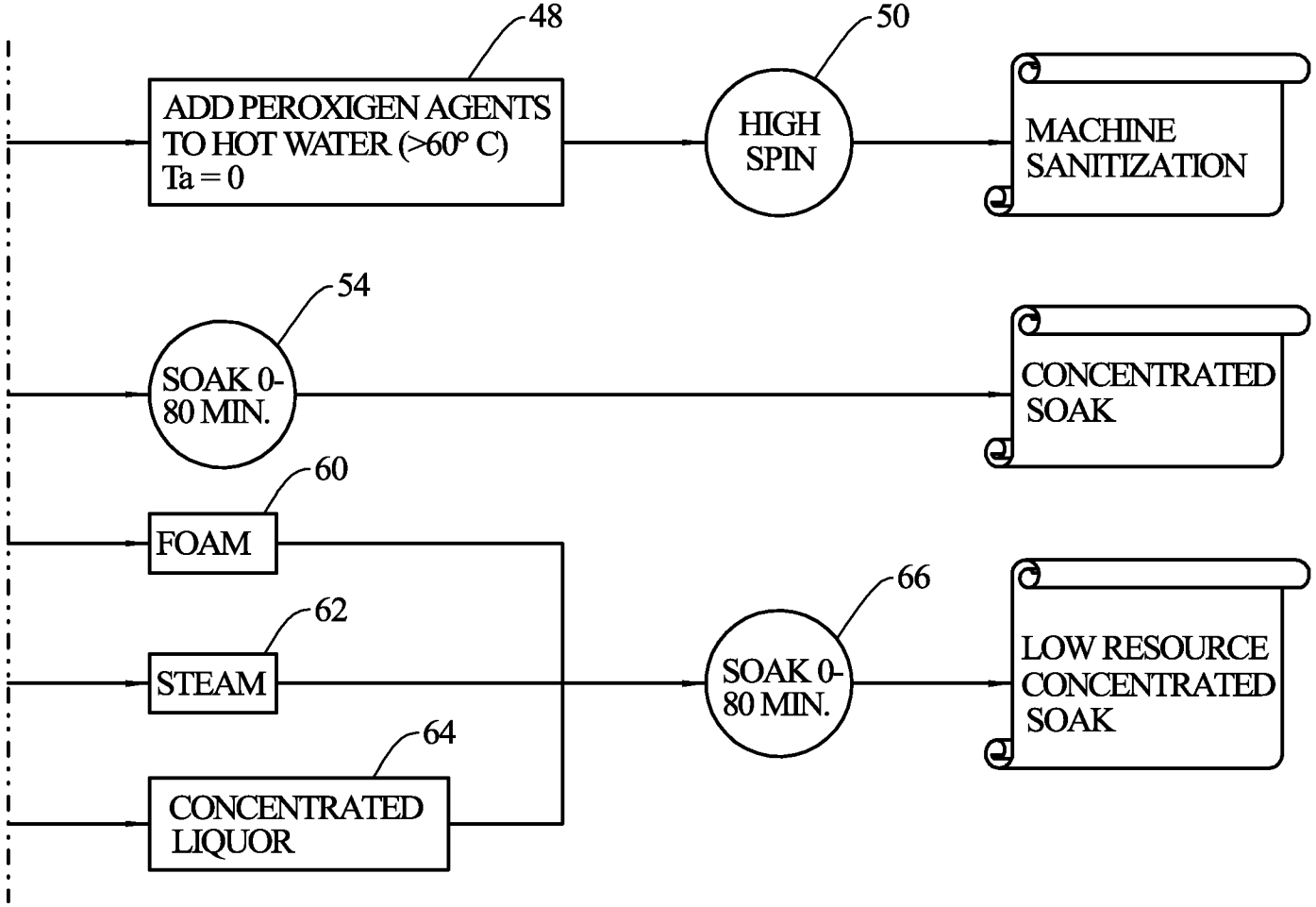

In FIGS. 2 and 2A-2B, there is illustrated a cycle for sanitizing the machine. In step 40, water is added by controlling the water inlet valves. In step 42, a determination is made as to whether a soaking operation has been selected. If that determination is yes, then a determination is made in step 44 regarding the selected water level. If the selected water level is regular, then a determination is made in step 46 regarding whether a fabric load 26 is present. If that determination is no, then the control 30 opens the hot water inlet valve to admit hot water, and also dispenses an oxidizing agent in step 48. The mixture of the oxidizing agent and the hot water in the wash zone sanitizes the wash zone. The drum defining the wash zone is then spun in step 50, to assure that all portions of the machine normally having contact with the wash liquor will be subjected to the sanitizing mixture of the oxidizing agent and water. This cycle helps to prevent and remove biofilms from surfaces in the washer. This cycle works best when the water temperature is >60.degree. C. The elevated temperature in this step, and in other steps can be achieved by admitting hot water, or by utilizing a heating element to heat the wash liquor after it is already in the wash zone, or as it is being prepared to be introduced into the wash zone, such as in a mixing chamber.

If in step 46 it is determined that a fabric load 26 is present, then the control dispenses an oxidizing agent in step 52 in an amount of 1 to 2 times the recommended amount and the fabric load is permitted to soak in the mixture of the oxidizing agent and water, in step 54, for a time period, such as up to about 80 minutes. The soaking step 54 can be carried out in a range of temperatures and is intended to be a prewash cycle, to be followed by one of the other wash cycles.

If in step 44 the selected water level is determined to be low, then in step 56 a recommended amount of oxidizing agent is added by the control 30. A determination is then made in step 58 regarding the phase that the wash liquor (here water and oxidizing agent) is to be applied to the fabric load 26. For example, the wash liquor could be applied in a foam phase, as shown in step 60, a steam phase as shown in step 62, or a concentrated wash liquor phase (low water volume) as shown in step 64. The fabric load 26 is then permitted to soak in the wash liquor, in step 66, for a time period, such as up to about 80 minutes. The soaking step 66 can be carried out in a range of temperatures and is intended to be a prewash cycle, to be followed by one of the other wash cycles. This particular soaking cycle requires less water than the previously described soaking cycle, and thus consumes less water resources.

Figures 3, 3A, 3B, 4, 5:
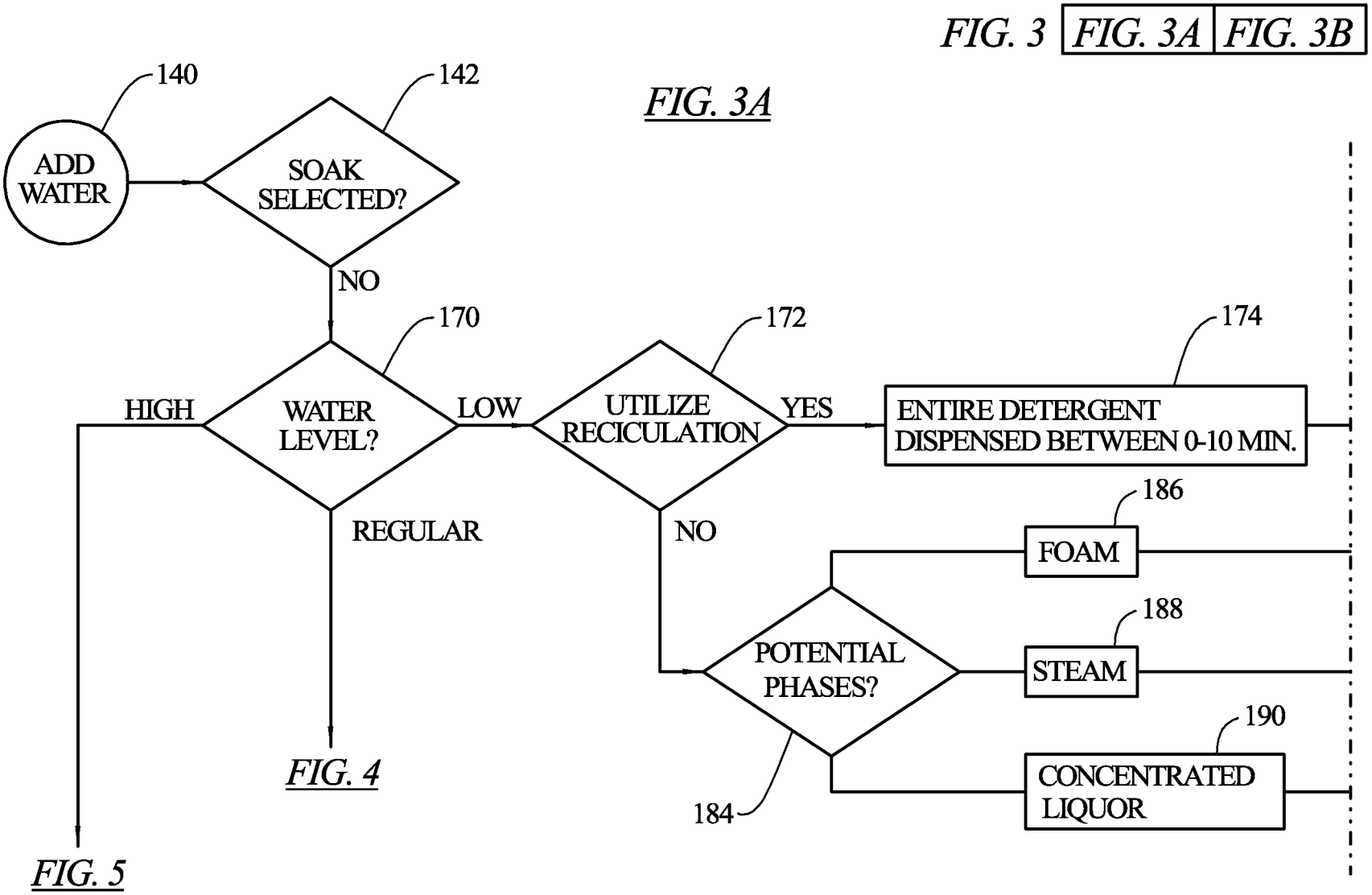
FIGS. 4 and 4A-4C illustrate a flow chart diagram of a wash cycle embodying the principles of the present invention.
FIGS. 5 and 5A-5C illustrate a flow chart diagram of a wash cycle embodying the principles of the present invention.
Figure 3B:
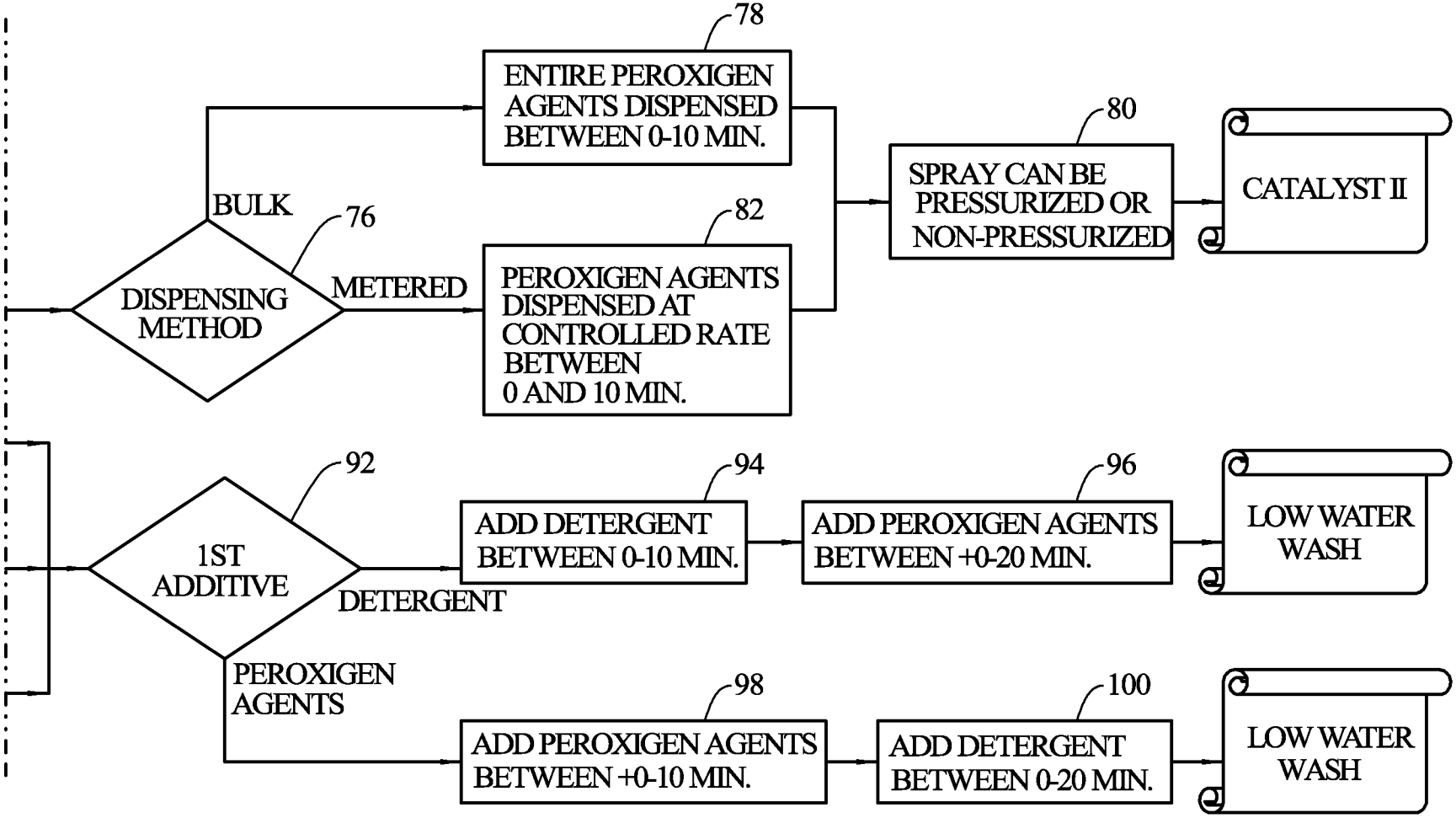
Figures 4, 4A, 4B, 4C, 5:
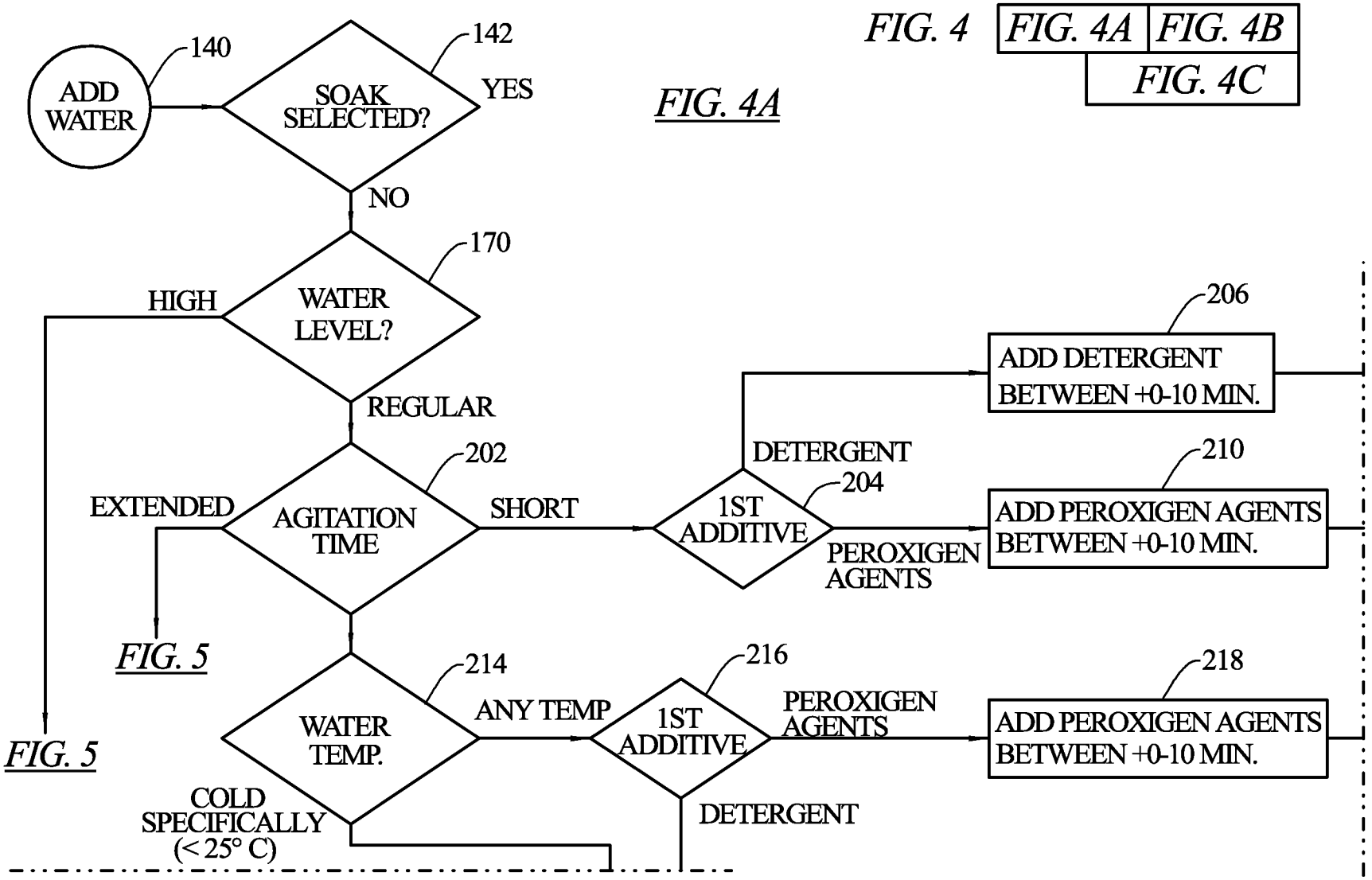
Figure 4B:
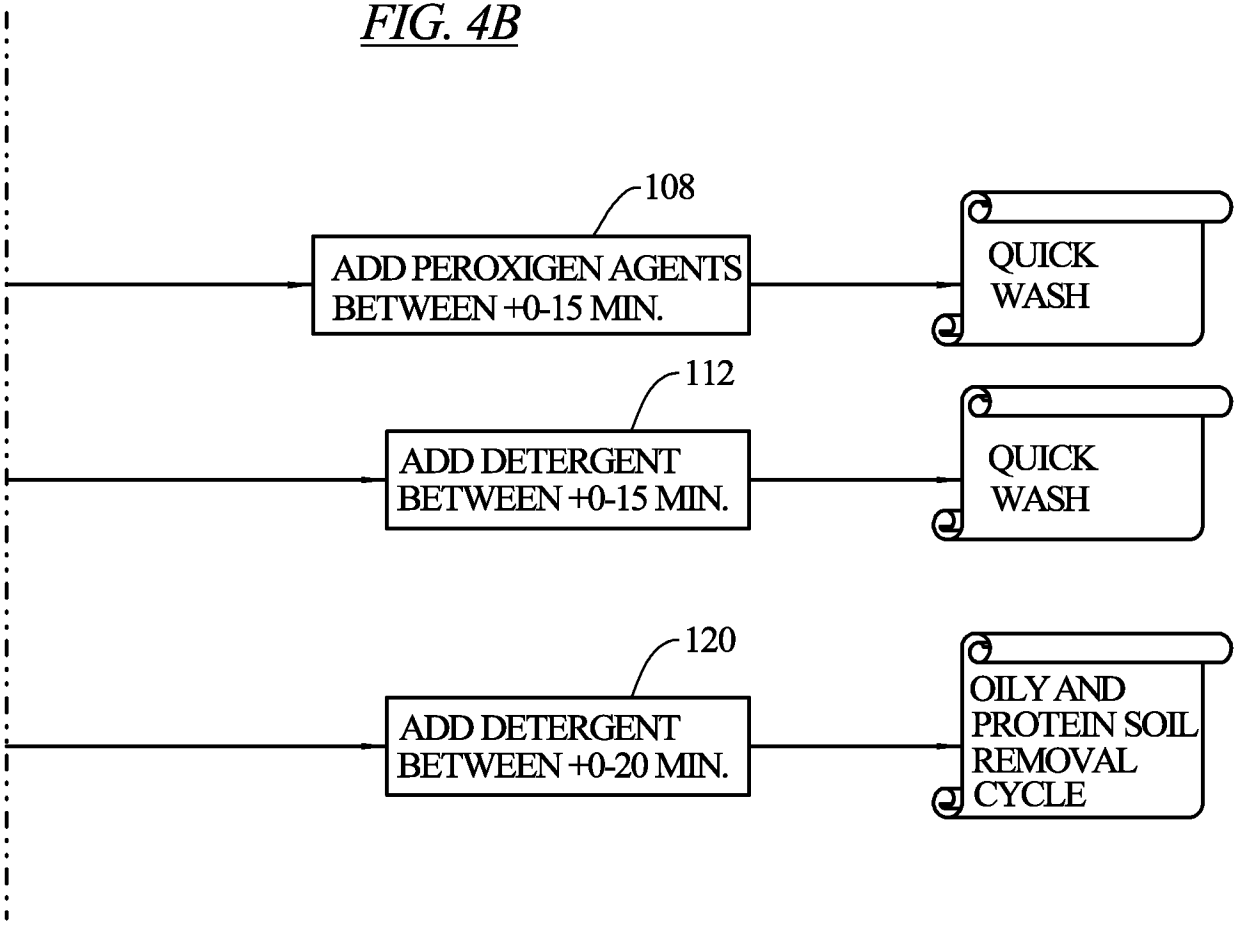
Figure 4C:
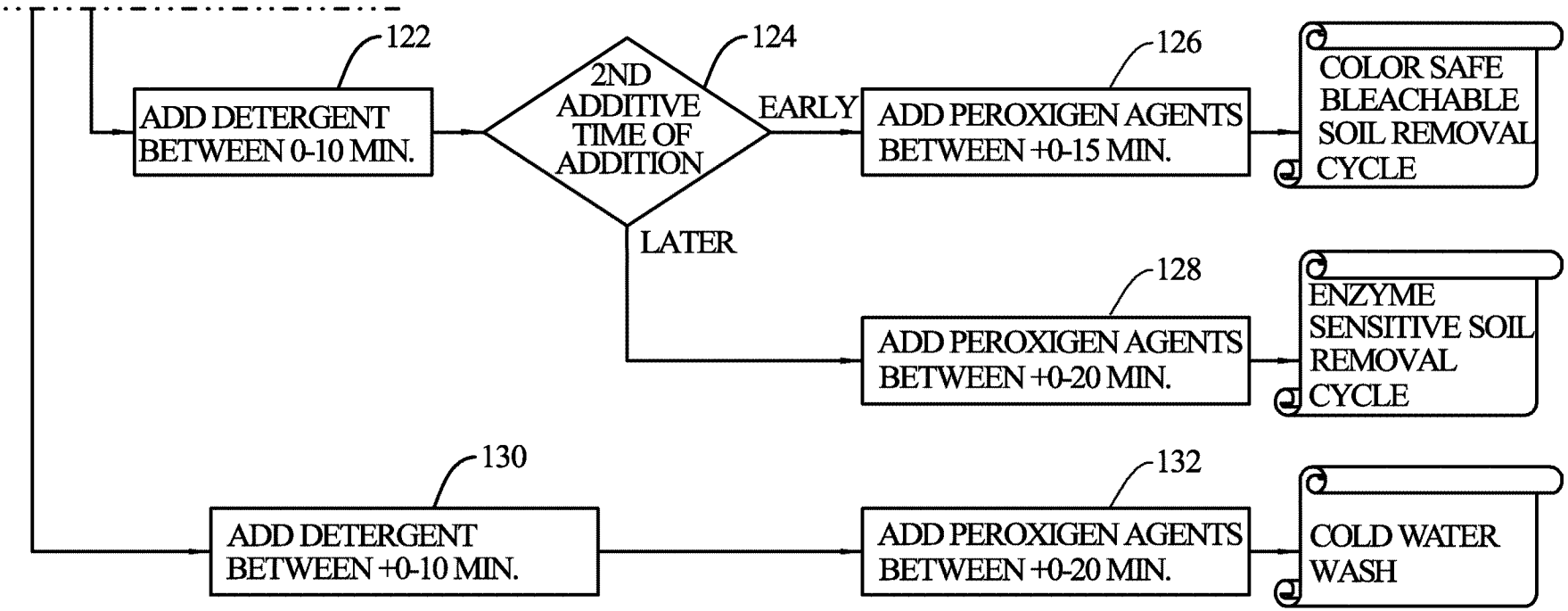
Figures 5, 5A:
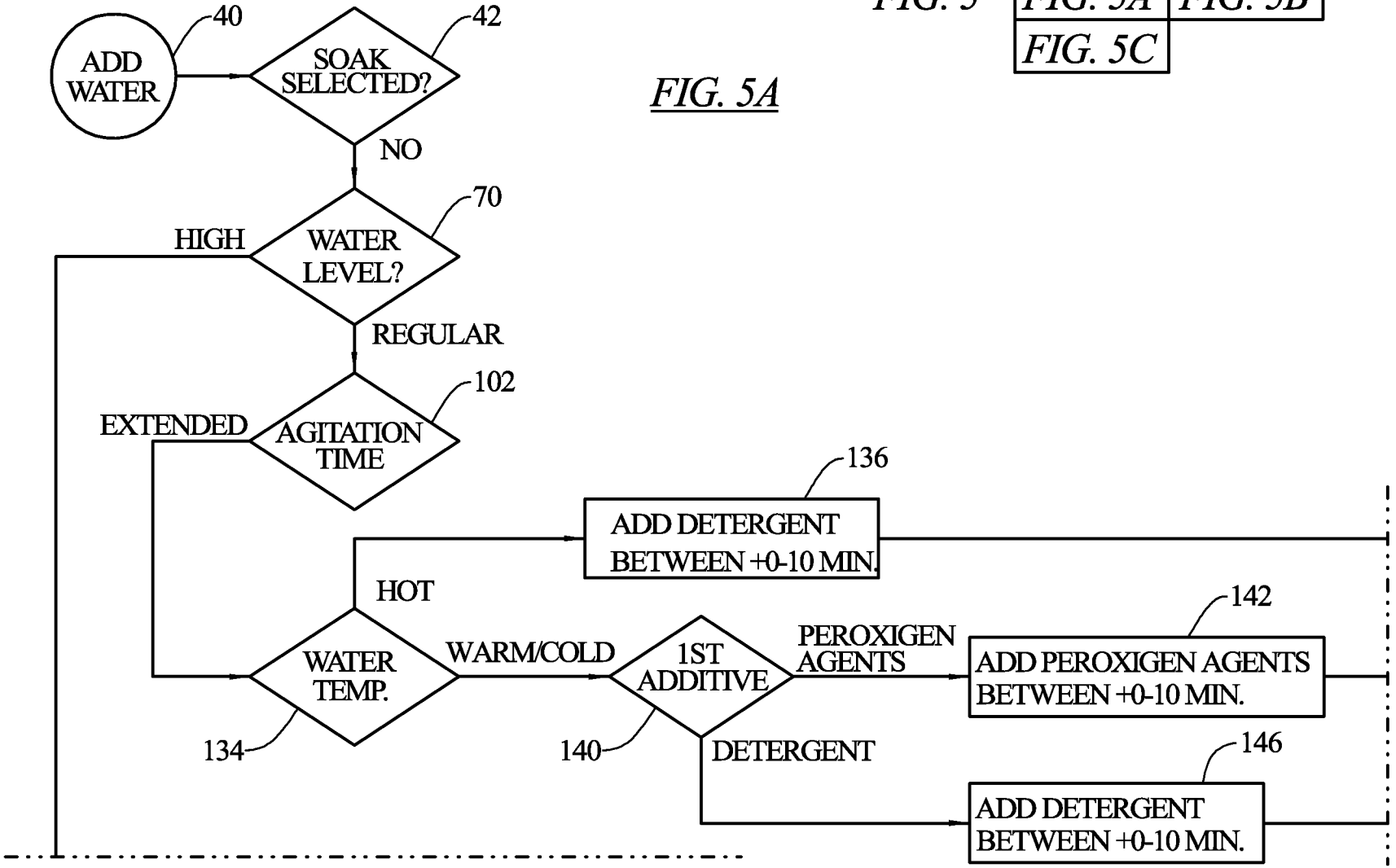
Figure 5B:
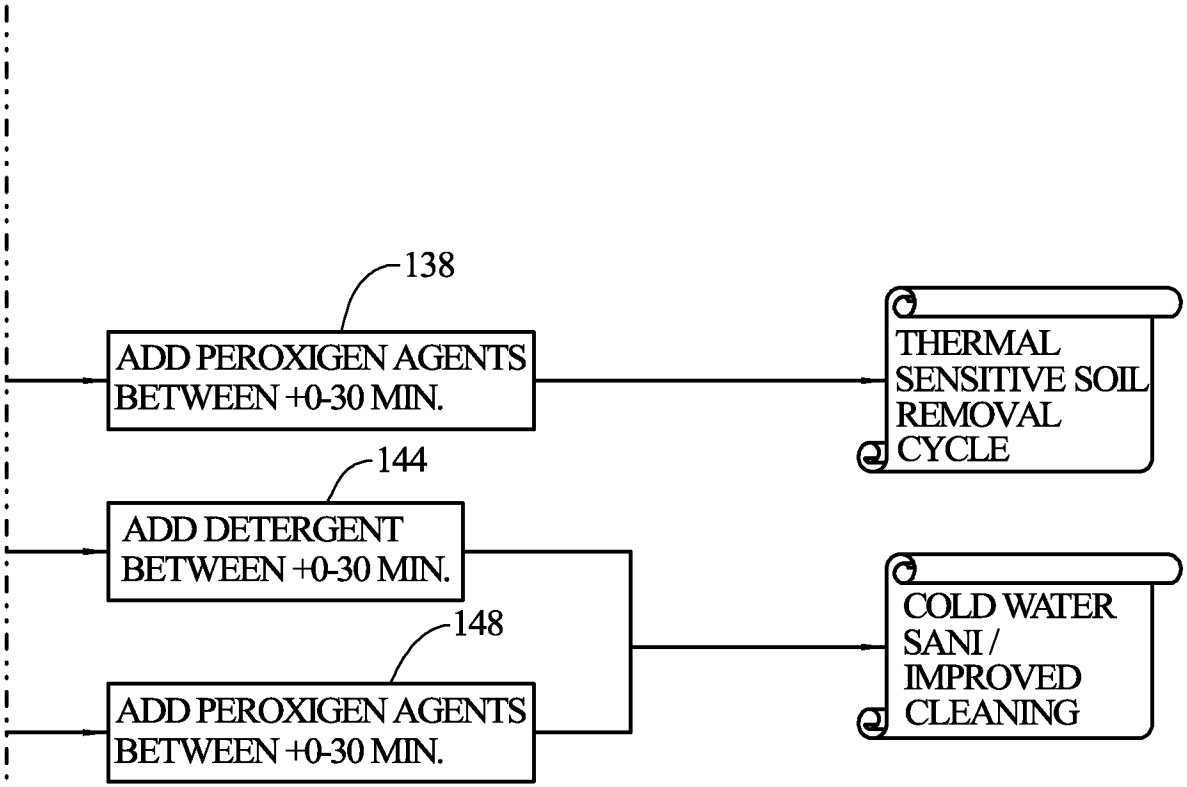
Figure 5C:
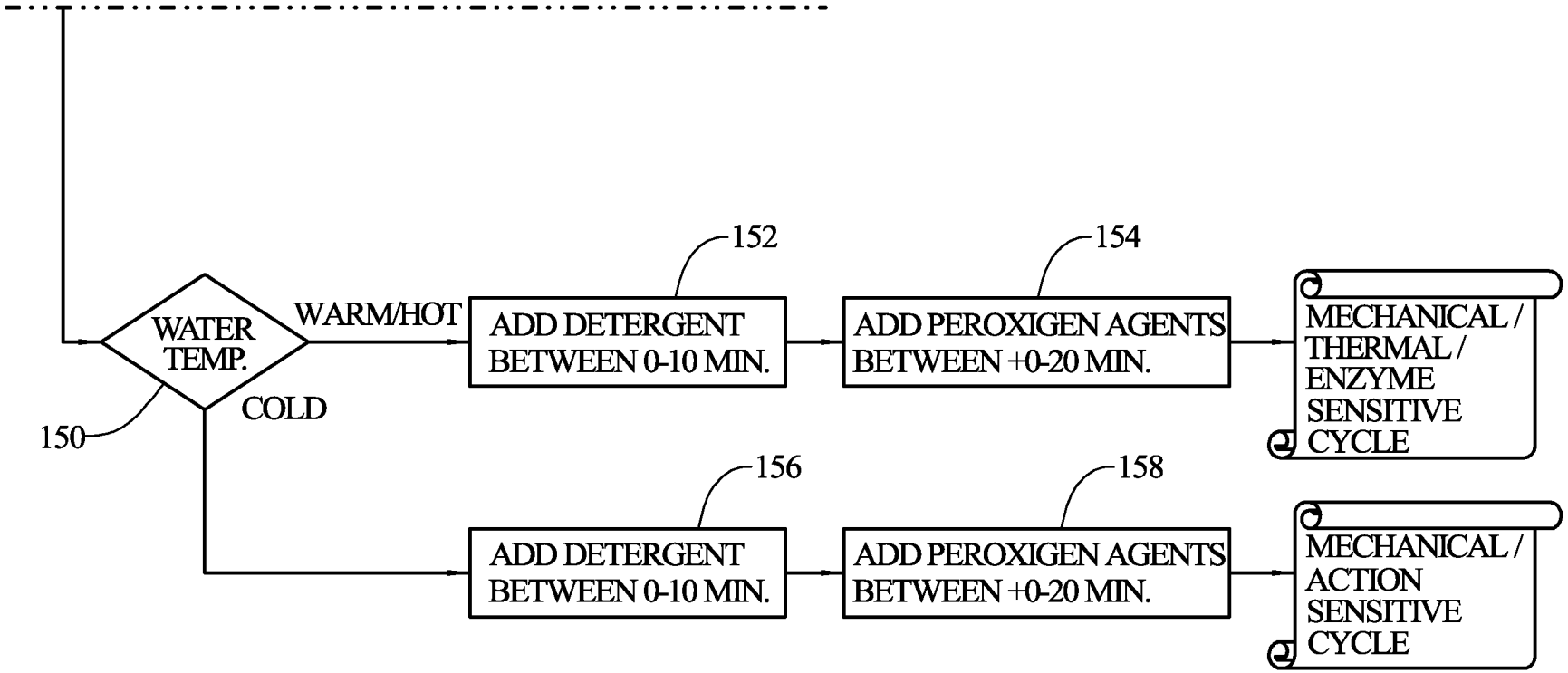

In FIGS. 3 and 3A-3B, there are illustrated several wash cycles based on low water levels. As water is added in step 40, and a determination is made in step 42 that soaking has not been selected, then a determination is made in step 70 with regard to a selected water level. If a low level has been selected, then in step 72, a determination is made regarding whether the wash liquor is to be recirculated through the fabric load 26. If recirculation is selected, then the control 30 operates the dispensing of the detergent to dispense the detergent into the wash liquor during an initial time period, ranging between 0 and 10 minutes from the start of this wash cycle, depending on the stain and soil types indicated. A prewetting with just water could be provided, prior to adding the detergent to the wash liquor, for certain types of stains. For other types of stains and soiling, it is more desirable to add the detergent sooner, or at the beginning of the wash cycle.

A determination is then made in step 76 regarding the method for dispensing the oxidizing agent. If a determination is made to add the oxidizing agent in bulk, then in step 78, the entirety of the charge of oxidizing agent is added during a second time period, ranging between 0 and 10 minutes from the start of this wash cycle, depending on the stain and soil types indicated. For some types of stains, it is more effective to allow the fabric load to be in contact with a detergent based wash liquor alone for a period of time before introducing an oxidizing agent. For other types of stains, it is more effective to introduce the oxidizing agent sooner, or together with the detergent. The wash liquor is then applied against the fabric load 26 via a spray or other known introduction methods including via a waterfall, through perforations in a wall of the wash zone, etc., in the recirculation mode, during step 80.

If the determination in step 76 is to meter the oxidizing agent into the wash liquor, then in step 82, the oxidizing agents are dispensed by the control 30 at a controlled rate during the second time period. For some types of stains or oxidizing agents, it is preferable to meter the oxidizing agent into the wash liquor over time, rather than dispensing it in bulk. Again, the wash liquor is then applied against the fabric load 26 by spraying in the recirculation mode, in step 80.

If the determination in step 72 was to not utilize recirculation of the wash liquor, then a determination is made in step 84 regarding the phase that the wash liquor is to be applied to the fabric load 26. For example, the wash liquor could be applied in a foam phase, as shown in step 86, a steam phase as shown in step 88, or a concentrated wash liquor phase (low water volume) as shown in step 90. A determination is then made in step 92 regarding the first additive to be dispensed into the wash liquor. If the determination is to first add detergent, then in step 94, the control 30 causes the detergent to be dispensed into the wash liquor during a first time period, ranging between 0 and 10 minutes from the start of this wash cycle, depending on the stain and soil types indicated as described above with respect to step 74. During a second time period in step 96, ranging between 0 and 20 minutes from the start of this wash cycle, the oxidizing agents are dispensed into the wash liquor. This cycle provides a low water usage wash cycle.

If in step 92 the first additive is determined to be an oxidizing agent, then in step 98, the control 30 causes the oxidizing agent to be dispensed into the wash liquor during a first time period, ranging between 0 and 10 minutes from the start of this wash cycle, depending on the stain and soil types. For some types of stains, it is more effective to first apply a wash liquor and oxidizing agent before introducing a detergent. During a second time in step 100, ranging between 0 and 20 minutes from the start of this wash cycle, the detergent is dispensed into the wash liquor. This cycle also provides a low water wash cycle which can be performed through a wide range of water temperatures.

In FIGS. 4 and 4A-4C, there are illustrated several wash cycles based on regular water levels and short or regular agitation times. As water is added in step 40, and a determination is made in step 42 that soaking has not been selected, then a determination is made in step 70 with regard to a selected water level. If a regular level has been selected, then in step 102, a determination is made regarding the length of the agitation time. If a short agitation time is selected, a determination is then made in step 104 regarding the first additive to be dispensed into the wash liquor. If the determination is to first add detergent, then in step 106, the control 30 causes the detergent to be dispensed into the wash liquor during a first time period, ranging between 0 and 10 minutes from the start of this wash cycle, depending on the stain and soil types indicated as described above with respect to step 74. During a second time period in step 108, ranging between 0 and 15 minutes from the start of this wash cycle, the oxidizing agents are dispensed into the wash liquor. This cycle provides a quick wash cycle.

If in step 104 the first additive is determined to be an oxidizing agent, then in step 110, the control 30 causes the oxidizing agent to be dispensed into the wash liquor during a first time period, ranging between 0 and 10 minutes from the start of this wash cycle, depending on the stain and soil types. During a second time in step 112, ranging between 0 and 15 minutes from the start of this wash cycle, the detergent is dispensed into the wash liquor. This cycle also provides a quick wash cycle.

If a regular agitation time is selected in step 102, a determination is then made in step 114 regarding a temperature for the wash liquor. If any temperature other than specifically cold is selected, then in step 116 is made regarding the first additive to be dispensed into the wash liquor. If the determination is to first add the oxidizing agent, then in step 118, the control 30 causes the oxidizing agent to be dispensed into the wash liquor during a first time period, ranging between 0 and 10 minutes from the start of this wash cycle, depending on the stain and soil types. During a second time period in step 120, ranging between 0 and 20 minutes from the start of this wash cycle, the detergent is dispensed into the wash liquor. This cycle provides a wash cycle particularly suited to remove oily soils and protein stains, such as blood or grass stains.

If in step 116 the first additive is determined to be a detergent, then in step 122, the control 30 causes the detergent to be dispensed into the wash liquor during a first time period, ranging between 0 and 10 minutes from the start of this wash cycle, depending on the stain and soil types. A determination is then made in step 124 whether the oxidizing agent is to be dispensed early or later. If the determination is early, then during a second time period in step 126, ranging between 0 and 15 minutes from the start of this wash cycle, the oxidizing agent is dispensed into the wash liquor. This cycle is suited for color safe bleachable soil removal.

If the determination in step 124 is to add the oxidizing agent later, then during a second time period in step 128, ranging between 0 and 20 minutes from the start of this wash cycle, the oxidizing agent is dispensed into the wash liquor. This cycle is suited for removing enzyme sensitive soils, which is why the oxidizing agent is dispensed into the wash liquor later, to allow the enzyme based detergent a longer contact time with the fabric load 26.

If a determination is made in step 114 specifically for a cold wash temperature, then in step 116, the control 30 causes the detergent to be dispensed into the wash liquor during a first time period, ranging between 0 and 10 minutes from the start of this wash cycle, depending on the stain and soil types indicated as described above with respect to step 74. During a second time period in step 132, ranging between 0 and 20 minutes from the start of this wash cycle, the oxidizing agents are dispensed into the wash liquor. This cycle provides a cold water wash cycle (reduced energy usage). It has been determined, using cleaning scores, that a wash cycle using detergent and an oxidizing agent, at temperatures between 15 and 25 C provides results as good as or better than a wash cycle using only a detergent at 40 C.

The various times listed for each of the steps are merely illustrative, and can be lengthened or shortened as desired to improve performance or other characteristics of the wash cycle.

In FIGS. 5 and 5A-5C, there are illustrated several wash cycles based on a regular water level and an extended agitation time or a high water level. As water is added in step 40, and a determination is made in step 42 that soaking has not been selected, a determination is made in step 70 for a regular water level and in step 102 a determination is made for an extended agitation time, a determination is made in step 134 regarding a wash temperature. If hot temperatures have been selected, then in step 136, the control 30 causes the detergent to be dispensed into the wash liquor during a first time period, ranging between 0 and 10 minutes from the start of this wash cycle, depending on the stain and soil types indicated as described above with respect to step 74. During a second time period in step 138, ranging between 0 and 30 minutes from the start of this wash cycle, the oxidizing agents are dispensed into the wash liquor. This cycle provides a wash cycle for removing thermally sensitive soils, such as oily soils.

If the temperature selected in step 134 is warm or cold, then in step 140 a determination is made regarding the first additive to be dispensed into the wash liquor. If the determination is to first add the oxidizing agent, then in step 142, the control 30 causes the oxidizing agent to be dispensed into the wash liquor during a first time period, ranging between 0 and 10 minutes from the start of this wash cycle, depending on the stain and soil types. During a second time period in step 144, ranging between 0 and 30 minutes from the start of this wash cycle, the detergent is dispensed into the wash liquor. This cycle provides a wash cycle that sanitizes and provides improved cleaning due to the extended period of time the fabric load is exposed to oxidizing agents.

If in step 140 the first additive is determined to be a detergent, then in step 148, the control 30 causes the detergent to be dispensed into the wash liquor during a first time period, ranging between 0 and 10 minutes from the start of this wash cycle, depending on the stain and soil types. During a second time period in step 148, ranging between 0 and 30 minutes from the start of this wash cycle, the oxidizing agent is dispensed into the wash liquor. This cycle also provides a wash cycle that sanitizes and provides improved cleaning due to the extended period of time the fabric load is exposed to oxidizing agents.

If a determination is made in step 70 for a high water level, a determination is made in step 150 regarding a wash temperature. If warm or hot temperatures have been selected, then in step 152, the control 30 causes the detergent to be dispensed into the wash liquor during a first time period, ranging between 0 and 10 minutes from the start of this wash cycle, depending on the stain and soil types indicated as described above with respect to step 74. During a second time period in step 154, ranging between 0 and 20 minutes from the start of this wash cycle, the oxidizing agents are dispensed into the wash liquor. This cycle provides a mechanical/thermal/enzyme sensitive wash cycle which is particularly suited for removing carbon and cocoa based soils and stains.

If the temperature selected in step 150 is cold, then in step 156, the control 30 causes the detergent to be dispensed into the wash liquor during a first time period, ranging between 0 and 10 minutes from the start of this wash cycle, depending on the stain and soil types. During a second time period in step 158, ranging between 0 and 20 minutes from the start of this wash cycle, the oxidizing agent is dispensed into the wash liquor. This cycle provides a mechanical action sensitive cycle (high water volume) with a lower energy usage (due to the cold water selection) than the previous wash cycle.

Various features and steps of the washer and washer control have been described which may be incorporated singly or in various combinations into a desired washer and washer control, even though only certain combinations are described herein. The described combinations should not be viewed in a limiting way, but only as illustrative examples of particular possible combinations of features.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

While at least one exemplary embodiment of the present invention has been shown and described, it should be understood that modifications, substitutions and alternatives may be apparent to one of ordinary skill in the art and can be made without departing from the scope of the invention described herein. This application is intended to cover any adaptations or variations of the specific embodiments discussed herein. In addition, in this application, the terms "comprise" or "comprising" do not exclude other elements or steps, and the terms "a" or "one" do not exclude a plural number. Furthermore, characteristics or steps which have been described with reference to one of the above exemplary embodiments may also be used in combination with other characteristics or steps of other exemplary embodiments described above.

The invention claimed is:

1. A method for cleaning a load of fabric, comprising:

defining a wash zone for receiving the load of fabric;

providing a first chamber for receiving a detergent additive;

providing a second chamber for receiving an oxidizing agent additive;

providing a controller arranged to operate a washer through a dedicated wash cycle;

providing a control interface to permit selection by a user of a selected stain type of a plurality of stain type entrees stored in a memory of the controller, wherein each of the stain type entrees is associated with a particular dedicated wash cycle stored in the memory of the controller;

automatically selecting the dedicated wash cycle associated with the selected stain type of the plurality of stain type entrees;

operatively connecting the controller to the first chamber and the second chamber to provide dispensing control for selectively dispensing the detergent additive and the oxidizing agent additive during the dedicated wash cycle;

operating the dedicated wash cycle, as automatically selected, using both the detergent additive and the oxidizing agent additive; and dispensing the detergent additive and the oxidizing agent additive wherein the controller is configured to dispense the detergent additive and the oxidizing agent additive in different orders, in different amounts, and at different times, based on the selected stain type.

2. The method of claim 1, further comprising determining a dispensing order for at least one of the detergent additive and the oxidizing agent additive based on the selected stain type.

3. The method of claim 1, further comprising dispensing the oxidizing agent additive during a predetermined time period after the detergent additive is dispensed, based on the selected stain type.

4. The method of claim 1, further comprising determining a dispensing method for the oxidizing agent additive based on the selected stain type.

5. The method of claim 4, further comprising including at least one of a metered method and a bulk method as the dispensing method.

6. The method of claim 1, wherein each wash cycle includes a first predetermined time period corresponding to the dispensing of the detergent additive and having a first begin time and a first end time, and a second predetermined time period corresponding to the dispensing of the oxidizing agent additive and having a second begin time and a second end time.

7. The method of claim 6, further comprising selecting one of the first and second predetermined time periods for dispensing the detergent additive, and the other of the first and second predetermined time periods for dispensing the oxidizing agent additive.

8. The method of claim 7, further comprising determining selection of the first and second predetermined time periods based on the selected stain type.

9. The method of claim 1, further comprising identifying and selecting the plurality of stain type entrees by a control menu of the control interface.

10. The method of claim 1, further comprising electronically displaying the plurality of stain type entrees in a control menu of the control interface.

11. A method for cleaning a load of fabric, comprising:

selecting, using a control interface, a selected stain type of a plurality of stain type entrees that are stored in a memory of a controller;

automatically selecting a dedicated wash cycle associated with the selected stain type, wherein each stain type entree of the plurality of stain type entrees is associated with a particular dedicated wash cycle stored in the memory of the controller;

performing the dedicated wash cycle within a wash zone, as automatically selected;

operating the controller during performance of the dedicated wash cycle to selectively dispense a detergent additive from a first chamber and an oxidizing agent additive from a second chamber; and dispensing the detergent additive and the oxidizing agent additive into the wash zone, wherein the controller is configured to dispense the detergent additive and the oxidizing agent additive in different orders, in different amounts, and at different times, based on the selected stain type.

12. The method of claim 11, further comprising determining a dispensing order for at least one of the detergent additive and the oxidizing agent additive based on the selected stain type.

13. The method of claim 11, further comprising dispensing the oxidizing agent additive during a predetermined time period after the detergent additive is dispensed, based on the selected stain type.

14. The method of claim 11, further comprising determining a dispensing method for the oxidizing agent additive based on the selected stain type.

15. The method of claim 11, wherein each wash cycle includes a first predetermined time period corresponding to the dispensing of the detergent additive and having a first begin time and a first end time, and a second predetermined time period corresponding to the dispersing of the oxidizing agent additive and having a second begin time and a second end time.

16. The method of claim 15, further comprising selecting one of the first and second predetermined time periods for dispensing the detergent additive, and the other of the first and second predetermined time periods for dispensing the oxidizing agent additive.

17. The method of claim 16, further comprising determining selection of the first and second predetermined time periods based on the selected stain type.

18. The method of claim 11, further comprising identifying and selecting the plurality of stain type entrees by a control menu of a control interface.

19. The method of claim 11, further comprising electronically displaying the plurality of stain type entrees in a control menu.

20. A method for cleaning a load of fabric, comprising:

defining a wash zone for receiving said bad of fabric;

selecting, using a control interface, a selected stain type from a list of stain type entrees that are stored in a memory;

automatically selecting, via a controller, a dedicated wash cycle associated with the selected stain type, wherein the controller is in communication with the memory, and wherein the dedicated wash cycle is associated with a wash cycle stored in the memory;

performing the dedicated wash cycle, as automatically selected; and operating the controller during performance of the dedicated wash cycle to selectively dispense a detergent additive from a first chamber and an oxidizing agent additive from a second chamber, wherein the controller is configured to dispense the detergent additive and the oxidizing agent additive into the wash zone in different orders in different amounts and at different times, based on the selected stain type.

* * * * *